United States Patent [19]

Tatsumi et al.

[11] 3,933,023

[45] Jan. 20, 1976

[54] METHOD FOR MANUFACTURING A UNIT PIECE OF A V PULLEY

[75] Inventors: Hideo Tatsumi, Hitachi; Tomoyoshi Hirazuka; Hisanobu Kanamaru, both of Katsuta, all of Japan

[73] Assignee: Hitachi, Ltd., Japan

[22] Filed: Feb. 26, 1975

[21] Appl. No.: 553,212

[30] Foreign Application Priority Data

Mar. 1, 1974 Japan ..... 49-23356

[52] U.S. Cl. ..... 72/359; 72/375; 29/159

[51] Int. Cl.[2] ..... B21K 1/42

[58] Field of Search ..... 72/358, 359, 375, 376; 29/159, 159.01; 74/230.8; 113/116 D

[56] References Cited

UNITED STATES PATENTS

| | | | |
|---|---|---|---|
| 1,007,944 | 11/1911 | Hansen | 72/375 |
| 1,650,780 | 11/1927 | Williams | 29/159.01 |

FOREIGN PATENTS OR APPLICATIONS

| | | | |
|---|---|---|---|
| 274,163 | 7/1927 | United Kingdom | 29/159 |
| 525,833 | 9/1940 | United Kingdom | 29/159 |
| 13,080 | 8/1956 | Germany | 72/358 |

*Primary Examiner*—Lowell A. Larson
*Attorney, Agent, or Firm*—Craig & Antonelli

[57] ABSTRACT

A method for manufacturing a unit piece for a V pulley of the type in which a pair of unit pieces of the same configuration are assembled in back-to-back relation to each other into a single complete pulley, said unit piece having a central flat portion and a circumferential V groove forming portion continuous with the flat portion, characterized by the steps of preparing a forging stock of a disk form of which the outer diameter is equal to the outer diameter $D_1$ of said pulley unit peice and the thickness is equal to the thickness T of the flat portion of said pulley unit piece; and cold-forging said forging stock for deforming an outer circumferential portion thereof so that the thickness of the portion is gradually reduced radially outwardly to define a cylindrical portion of height L as well as an outermost circumference of thickness $T_1$ and n innermost circumference of thickness $T_2(T_1<T_2)$ to form said circumferential V groove forming portion whereby the pulley unit piece is formed in such an efficient manner that the material of the forging stock of disk form is effectively plastic-deformed into the unit piece.

3 Claims, 3 Drawing Figures

METHOD FOR MANUFACTURING A UNIT PIECE OF A V PULLEY

BACKGROUND OF THE INVENTION

This invention relates to a method for manufacturing a unit piece of a V pulley, and more particularly to a method for manufacturing a unit piece a pair of which are assembled in back-to-back relation into a single complete V pulley which is well adapted for use in a small-sized rotary machine.

It has been a common practice in manufacturing a V pulley for use such as in a vehicle electric charging generator to machine a cast-iron block or steel block to a desired shape. In case of the cast-iron, a metal stock is melted under heat for casting the same into a cast mold, so that such a method surffers from an increasing amount of material expenses, heat and light expenses and expenses for man power which are all required for melting and casting the material. In addition, the machining cost required for cutting the casting to desired accuracy by a device such as lathe is increased, with the accompanying increase in energy required for melting the metal stock as well as in energy required for machining the casting, thus resulting in considerable disadvantages.

On the other hand, there is known a steelplate pulley which is manufactured by subjecting a circular steelplate having a thickness T to drawing to thereby provide a pulley unit piece of a dish form. However, such an attempt is also confronted by shortcomings in that, since the thickness of the pulley unit piece is uniformly equal to the aforesaid thickness, the weight of the assembled pulley is considerable and the pulley, when in use, produces resonance with the vibration in a rotary machine, and in that since the thickness T is relatively large, there has been increased the inertia of the pulley. Those shortcomings are apparently undesirable from every viewpoint in a pulley.

SUMMARY OF THE INVENTION

It is an object of the present invention to provide a method for manufacturing a unit piece of a V pulley with less amount of a material and a minimized man power.

According to the present invention, there is provided a method for manufacturing a unit piece of a V pulley, comprising the steps of preparing a forging stock of a disk form which has an outer diameter equal to the outer diameter of the pulley unit piece and a thickness equal to the thickness of a flat portion of the unit piece, and cold-forging the forging stock so as to define an outer circumferential portion thereof into such a V groove forming portion that the thickness thereof is gradually reduced radially outwardly whereby said pulley unit piece is formed in such an efficient manner that the material of the forging stock of disk form is effectively plastic-deformed into a form of the pulley unit piece with the accompanying saving in material and energy required.

In this specificaiton, meant by the words "unit pieces of V pulley" as used herein should be understood to be right and left-hand parts which are symmetrical to each other and which, when assembled, forms a single complete V pulley having a V groove in its circumference. Thus, it will be noted that one unit piece gives right or left-hand half of the intended pulley.

DESCRIPTION OF THE PREFERRED EMBODIMENT

Figure 1:
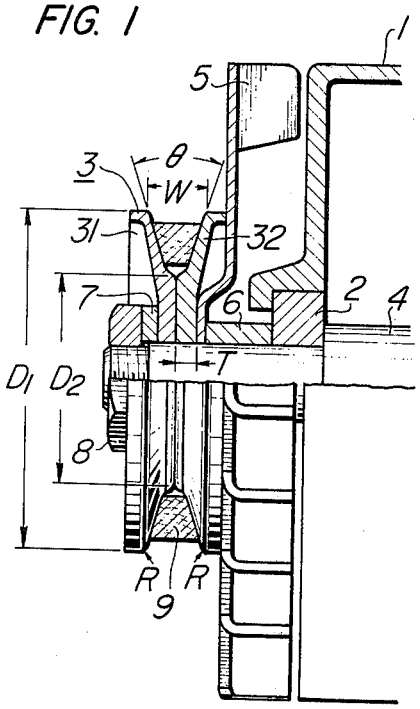
FIG. 1 is a cross sectional view of a pulley assembly consisting a pair of right and left-hand pulley unit pieces which are manufactured according to the method of the invention.

Description will now be given in attempt to explain the method of the present invention with reference to FIGS. 1 to 3. Referring to FIG. 1, shown at 1 is a body proper of a rotary machine, at 2 a bearing element, and at 3 a V pulley mounted on a rotating shaft 4. The V pulley 3 is composed of a pair of pulley unit pieces 31 and 32 which are assembled in a back-to-back relation into a single complete one. The unit pieces 31 and 32 are symmetrical to each other, i.e., the so-called right and left-hand parts. The pulley thus assembled has an outer diameter $D_1$, pulley groove inner diameter $D_2$, pulley groove width W, pulley groove angle $\theta$ and radius of curvature at its circumferential edges R. If desired, a fan 5 may be mounted on the shaft 4 for cooling the body of the machine. The pulley assembly 3 is secured to the end portion of the rotating shaft 4 through the fan 5, a spacer 6, and a spring washer 7 by means of a nut 8. Shown at 9 is a V belt which is entrained around the pulley along its V groove. The V belt has a wedge form in its cross section and thus produce a frictional transmitting force onto the surface of the V groove to serve as driving force for the pulley assembly. Due to this wedge form, there will be produced a force which tends to spread the pulley unit pieces in such a direction as to avert oneself from each other, but this force will be counteracted by the nut 8 so that the unit pieces are stably secured in place. In addition, for withstanding a load acting onto the pulley assembly and for reducing an inertia of same as well as for presenting light weight, it is desirable to design the pulley unit piece so that the thickness thereof becomes $T > T_2 > T_1$, as shown in FIG. 2.

Figure 3:
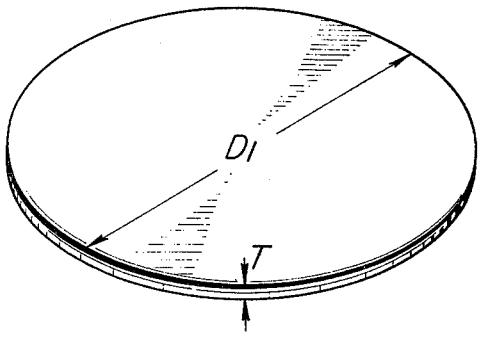
FIG. 3 is a perspective view of a forging stock of the pulley unit piece embodying the present invention.

Turning now to the method for manufacturing the unit pieces 31 and 32, there is provided a flat steel plate of a thickness T and an outer diameter $D_1$, as shown in FIG. 3.

Figure 2:
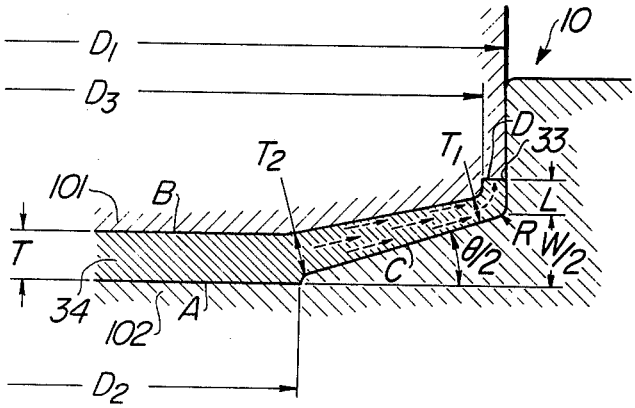
FIG. 2 is a cross sectional view of a pulley unit piece in which the unit piece is being subjected to forging according to the method of the present invention.

In FIG. 2, shown at 10 is a cold-forging die that is used for manufacturing the pulley unit pieces 31 and 32. The cold-forging die 10 consists of a pair of upper and lower halves 101 and 102 which are engraved respectively to configurations of the pulley unit pieces 31 and 32. The lower half 102 is formed to include a portion having a circumferential inner wall of a diameter substantially equal to the outer diameter $D_1$ of the forging stock to hold the forging stock of outer diameter $D_1$ and serves to define a V groove forming portion of the pulley unit piece into a dimension of pulley groove width W, pulley groove angle $\theta$ and radius of curvature at its circumferential edges R. The upper half 101 is so formed that upon forging operation, the thickness of the forging stock portion within a range of a diameter equal to the groove inner diameter $D_2$ of the pulley unit piece is maintained as it is, and a V groove forming portion of the stock, that is the stock portion within a range from a diameter equal to the groove inner diameter $D_2$ of the unit piece to a diameter equal to the outer diameter $D_1$ of same is gradually reduced in its thickness radially outwardly, i.e., toward the diameter $D_1$. In this connection, it should be noted that there is a relation $T > T_2 > T_1$ in said thickness.

In the method using the above mentioned forging die for manufacturing a pulley unit piece, the outer diameter of the forging stock of a disk form is taken as being equal to the outer diameter $D_1$ of the pulley unit piece, so that the forging stock is securely received in the lower half 102 in concentric relation thereto while being shaped under pressure into a unit piece by the upper half 101.

In addition, the thickness of the forging stock portion covered by a diameter equal to the groove inner diameter $D_2$ of the unit piece is taken as being equal to the thickness of the flat portion of the pulley unit piece, so that during forging operation, only the V groove portion and cylindrical portion 33 are securely subjected to forging with a central portion 34 of the stock held in position and thus the plastic deformation of metal material is performed in the manner that the material flows steadily towards the cylindrical portion 33, that is an outer circumferential portion which is necessary to outwardly gradually decrease the thickness. In addition, the surfaces A, B, C, and D of the pulley unit piece which is each required a suitable flatness are manufactured to the flatness less than 0.05 mm by a single operation of cold-forging, thereby eliminating further machining operation which would be otherwise necessary. Thus, it will be noted that the metal material of the forging stock is utilized 100 percent effectively.

It will be noted that if it is required to provide a pulley unit piece of the following dimensions;

outer diameter $D_1 = 74$ mm: pulley groove inner diameter $D_2 = 42$ mm: inner diameter $D_3 = 69$ mm: pulley groove width $W = 10$ mm: pulley groove angle $\theta = 34°$: radius of curvature $R = 15$ mm: height of outer circumferential face $L = 5$ mm: thickness of pulley flat portion $T = 4$ mm: and thickness of V groove forming portion $T_1$ and $T_2 = 2.5$ and 3.5 mm, respectively, It will be satisfactory to employ a foring stock of an outer diameter 74 mm equal to the outer diameter of the pulley unit piece to be forged and of a thickness 4 mm equal to that of the flat portion of same.

The advantages of the pulley unit piece according to the above mentioned method are as follows;

1. The stable positioning of a forging stock may be achieved during forging operation, and thus the flow of plastic deformation of the metal material is very smooth. 2. The material of the forging stock can be utilized 100 percent effectively without producing waste material. The flatness of the mating surface A, fixing surface B, V groove surface C and fan attaching surface D may be maintained within the flatness less than 0.05, which leads to no need of further machining. These permits saving both in material and in energy. 3. The thickness of the portion having the V groove surface C is forged to a thickness smaller than the thickness of a forging stock, so that there may be achieved a work-hardening effect therein. For instance, when the hardness of the forging stock which is soft enough for being subjected to forging is in a range of 100 to 120 in micro-Vickers hardness, the hardness of the C surface portion obtained is proved to be within a range of 150 to 190 in micro-Vickers hardness, thereby presenting good wear-resistance against the sliding movement of a V belt thereon. 4. The thickness of a unit piece is gradually reduced as it goes closer to the outer circumferential portion thereof (to the outer diameter $D_1$) with having a relationship of $T > T_2 > T_1$. As a result, the thickness of a unit piece portion which is close to a center thereof and receives a wedge force by the V belt may be increased to a maximum extent and thus a mechanically stable pulley assemble is presented. In addition, a V pulley receives vibration from the rotary machine and tends to cause resonance like a disk plate having a fixed axis, but since the pulley unit piece has a reduced thickness in the outer diameter portion but an increasing thickness toward its center, the V pulley assembly is mechanically very tough. In other words, the resonance frequency is high and the stress acting on the shaft-fixed portion is less. In addition, the unbalancing degree of a pulley depends on the non-uniformity in its thickness and eccentricity, but since the thickness of the pulley unit piece is outwardly reduced and the weight is light, there results little unbalancing degree according to the present invention.

What is claimed is:

1. A method for manufacturing a unit piece for a V pulley of the type in which at least a pair of unit pieces of the same configuration are assembled in back-to-back relation to each other into a single complete pulley, said unit piece having a central flat portion and a circumferential V groove forming portion continuous to the flat portion, characterized by the steps of preparing a forging stock of a disk form of which the outer diameter is equal to the outer diameter $D_1$ of the pulley unit piece and the thickness is equal to the thickness T of said flat portion of the pulley unit piece; and cold-forging said forging stock by means of at least a pair of upper and lower halves of a forging die for deforming an outer circumferential portion thereof so that the thickness of the portion is gradually reduced radially outwardly to form said circumferential V groove forming portion.

2. A method for manufacturing a unit piece for a V pulley as set forth in claim 1, wherein one half of said forging die includes a portion having a circumferential inner wall of a diameter substantially equal to the outer diameter $D_1$ of said forging stock for the pulley unit piece, said forging stock being held by said circumferential inner wall during said forging operation.

3. A method for manufacturing a unit piece for a V pulley as set forth in claim 1, wherein said forging stock is subjected to forging so as to form a portion of said stock within a range from a diameter equal to the groove inner diameter $D_2$ of the pulley unit piece to a diameter equal to the outer diameter $D_1$ of the same into said V groove forming portion so that the thickness thereof is gradually reduced radially outwardly.

* * * * *